United States Patent [19]

Hüttemann

[11] Patent Number: 4,800,740

[45] Date of Patent: Jan. 31, 1989

[54] ROTARY SWITCH APPARATUS FOR CYCLE SELECTION ON AN AUTOMATIC WASHING MACHINE

[75] Inventor: Wilfried Hüttemann, Bielefeld, Fed. Rep. of Germany

[73] Assignee: Miele & Cie. GmbH & Co., Gutersloh, Fed. Rep. of Germany

[21] Appl. No.: 936,215

[22] Filed: Dec. 1, 1986

[30] Foreign Application Priority Data

Dec. 2, 1985 [DE] Fed. Rep. of Germany ..... 3542503

[51] Int. Cl.[4] ..... D06F 33/02

[52] U.S. Cl. ..... 68/12 R

[58] Field of Search ..... 68/12 R

[56] References Cited

U.S. PATENT DOCUMENTS

| | | | |
|---|---|---|---|
| 3,978,693 | 9/1976 | Worst | 68/12 R |
| 4,054,412 | 10/1977 | Brummett et al. | 8/158 |
| 4,175,409 | 11/1979 | Morey | 68/4 |
| 4,193,275 | 3/1980 | Bochan | 68/134 |
| 4,207,760 | 6/1980 | Bochan | 68/18 |
| 4,231,130 | 11/1980 | Tobita et al. | 8/159 |
| 4,237,565 | 12/1980 | Torita et al. | 8/158 |
| 4,307,588 | 12/1981 | Smith et al. | 68/23.7 |
| 4,330,081 | 5/1982 | McMillan | 236/12 |
| 4,502,303 | 5/1985 | Wasemann | 68/23.2 |
| 4,563,911 | 1/1986 | Chauvigne | 74/125 |

FOREIGN PATENT DOCUMENTS

| | | | |
|---|---|---|---|
| 1964276 | 7/1967 | Fed. Rep. of Germany . | |
| 2112554 | 7/1983 | United Kingdom | 68/12 R |
| 2136601 | 9/1984 | United Kingdom | 68/12 R |

*Primary Examiner*—Philip R. Coe

*Attorney, Agent, or Firm*—Nils H. Ljungman

[57] ABSTRACT

On a rotary switch apparatus for the cycle selection on a washing machine, the cycle data are arranged in a circular fashion around the rotary switch. Variable adjustable temperature ranges are assigned to each wash cycle, so that appropriate temperature values can be individually set and selected for various types of fabrics.

21 Claims, 3 Drawing Sheets

ROTARY SWITCH APPARATUS FOR CYCLE SELECTION ON AN AUTOMATIC WASHING MACHINE

BACKGROUND OF THE INVENTION

1. Field of the Invention:

The invention relates generally to a rotary switch apparatus for setting the wash cycle on an automatic washing machine, and more specifically to a cycle selector with cycle data arranged in a circular fashion around the rotary switch on an indicator field of the control panel.

2. Description of the Prior Art:

Rotary switches of the type described above have become known on automatic washing machines under the term "single-dial control". Such a control is used to preset all the washing factors, by means of a single control element. The temperature is determined for each wash cycle and is assigned to the corresponding cycle as a fixed temperature stage. A disadvantage of these so-called single-dial machines is that on account of the great variety of fabrics currently on the market, such a rigid cycle configuration no longer necessarily satifies all the washing requirements. Therefore, there has been a recent trend toward multi-button operation, in which there is a separate temperature selector. Using such a system, each wash cycle can then be run individually with a different temperature. An inherent disadvantage of such a system, however, is that the setting of the corrent temperature can frequently be overlooked, or an improper temperature can be set, as a result of which certain types of items can be washed at improper temperatures.

Some examples of prior art automatic washing machines are found in U.S. Pat. No. 4,237,565, entitled "Automatic Washing Machine"; U.S. Pat. No. 4,231,130, entitled "Automatic Washing Machine and Method for Operating Same", U.S. Pat. No. 4,307,588, entitled "Automatic Clothes Washing Machine"; U.S. Pat. No. 3,978,693, entitled "Belt Drive Mechanism for Automatic Clothes Washing Machine"; U.S. Pat. No. 4,563,911, entitled "Programmer Control Device"; U.S. Pat. No. 4,502,303, entitled "Washing Machine Tub Construction"; U.S. Pat. No. 4,330,081, entitled "Water Temperature Control System for a Clothes Washing Machine"; U.S. Pat. No. 4,207,760, entitled "Vane Arrangement for Clothes Washing Machine"; U.S. Pat. No. 4,193,275, entitled "Agitator Mechansim for Clothes Washing Machine"; U.S. Pat. No. 4,175,409, entitled "Clothes Washing Machine" and U.S. Pat. No. 4,054,412, entitled "Clothes Washing Machine and Method of Washing Clothes", all of which are incorporated herein by reference as if the contents thereof were fully set forth in their entirety herein.

OBJECTS OF THE INVENTION

An object of the invention is to provide a rotary switch apparatus of the type described above, in which the user is offered cycles which are simple to comprehend and easy to select.

Another object of the invention is to provide a unitary wash cycle selector which has various temperature indicators in each fabric cycle shown on the washing machine.

Yet another object of the invention is to provide a unitary wash cycle selector which prevents the user from selecting a temperature which could damage the fabrics being washed in a selected washing cycle.

A further object of the invention is to provide a unitary wash cycle selector in which the washing cycle and the appropriate wash water temperature can be selected in one movement and on one indicator.

A yet further object of the invention is to provide a unitary wash cycle selector which prevents damage to clothing or fabrics being washed, by restricting the water temperature being selected to an appropriate temperature in the appropriate temperature range for that particular clothing or fabric.

A still further object of the invention is to provide a unitary wash cycle selector which is easy to use.

SUMMARY OF THE INVENTION

The cycle selection apparatus according to an embodiment of the invention allows the user to select the appropriate wash cycle with only one selection process. In addition, the washing machine cycles are simple to comprehend and easy to select. Damage to the fabrics resulting from improper settings is also largely prevented.

One aspect of the invention resides broadly in an automatic washing machine with a plurality of wash cycles having a motor and a wash drum mechanically connected to the motor and a water inlet for admitting water into the washing machine. A water temperature control is connected to control the temperature at least of the water in the washing machine. A control panel is disposed on the automatic washing machine. A single switch for selecting a wash cycle among a plurality of wash cycles of the automatic washing machine is disposed on the control panel. The single switch moves between and indicates the plurality of wash cycles along a single coordinate, indicating the plurality of wash cycles. Each of the wash cycles have a predetermined water temperature range associated therewith. The switch has apparatus for restricting a water temperature range within its predetermined, specific, individual temperature range for its corresponding wash cycle. The switch also displays each wash cycle and its temperature range, each temperature range being restricted to its predetermined temperature range for its wash cycle. Cycle data is disposed on the display and arranged in a circular fashion with respect to the switch. The switch is connected to the water temperature control to control temperature of at least the water in the washing machine whereby a predetermined variably adjustable temperature range is assigned to each of the individual wash cycles. Each of these temperature ranges lies within the limits allowable for the appropriate fabrics to be washed in that wash cycle. A selection of wash cycle and temperature can only be made which correspond to a desired wash cycle and a temperature in its predetermined temperature range in one unambiguous and unitary selection.

Another aspect of the invention resides broadly in an automatic washing machine having a motor and a wash drum mechanically connected to the motor. The washing machine comprises a water inlet for admitting water into the washing machine. A water temperature control is connected to control a temperature at least of water in the washing machine. A control panel is disposed on the automatic washing machine. The washing machine has a unitary wash cycle selector for selecting a wash cycle among a plurality of wash cycles of the automatic washing machine. The cycle selector is disposed on the control panel. The wash cycle selector control is connected to and controls the water temperature control. The unitary wash cycle selector comprises an apparatus for selecting various wash cycles with the single unitary selector. The wash cycles are disposed in a substantially continuous fashion along a selection sequence of the unitary selector. Each of the washing machine cycles for various washing machine conditions have its own corresponding temperature selection apparatus. Each temperature selection apparatus has a temperature selection range. Each temperature selection range lies within its own individual predetermined range. Each of the predetermined ranges of temperature is equivalent to appropriate ranges of temperature for fabrics to be washed in each corresponding cycle. The unitary wash cycle selector control has apparatus for restricting choice of the water temperatures to limit choice of water temperature in each individual wash cycle within a predetermined range for that corresponding wash cycle. Apparatus for displaying the selected wash cycle and a temperature range restricted to a corresponding temperature range of the selected wash cycle, whereby the unitary selector comprises a single structure for selecting a wash cycle and a predetermined temperature within its wash cycle in one unambiguous and unitary selection.

DESCRIPTION OF THE PREFERRED EMBODIMENTS

Figure 1:
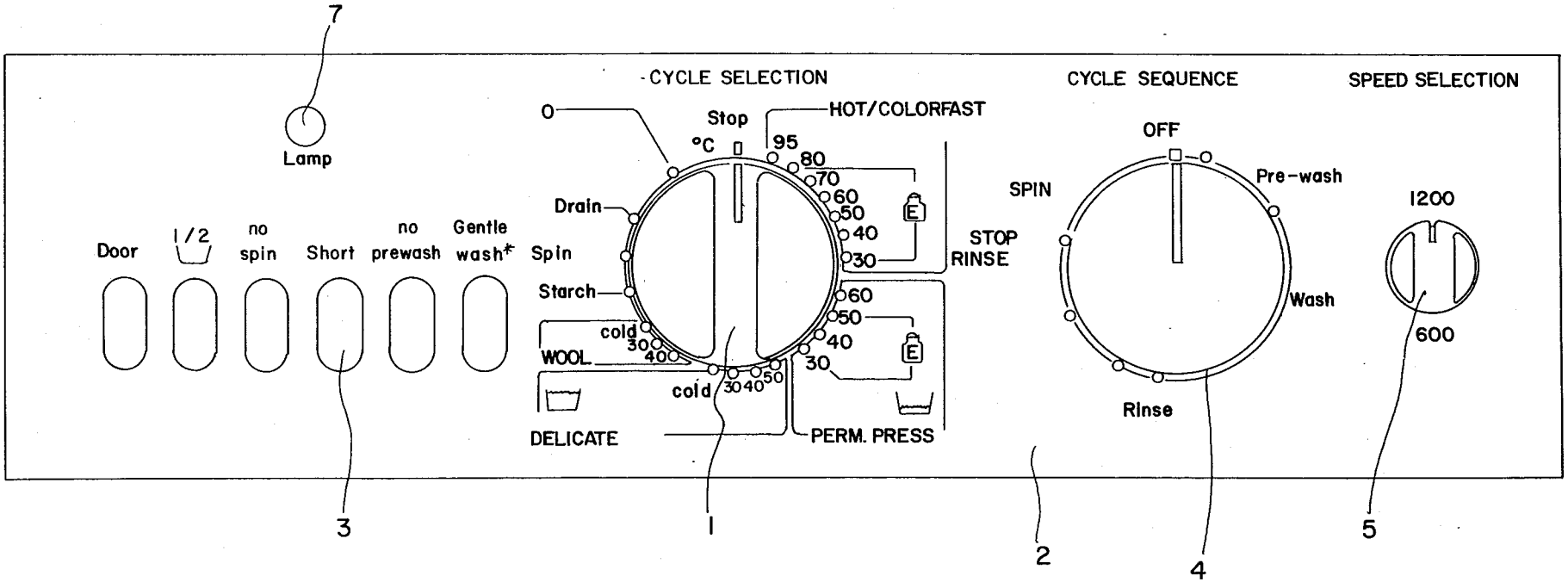
FIG. 1 is a schematic illustration of one embodiment of the invention which allows the layout of a cycle selection apparatus in the control portion or panel of a washing machine.

In FIG. 1, a control panel 2 for an automatic washing machine is shown. Disposed on the control panel, a cycle selector switch 1 is preferably designed as a rotary switch and the appropriate instructions for the wash cycle and the temperature stages are arranged in a circular fashion preferably on the stationary portion of the control panel 2. Alternatively, all the information may be arranged on a disc attached to the rotary switch. In an alternative embodiment, a linearly sliding switch, such as a slide switch, could be substituted for the rotary switch of the embodiment of FIG. 1. In this alternative embodiment, the switch would move linearly along a straight line, preferably with the information relating to wash cycles, etc., as indicated in the next paragraph and further infra, would also be disposed along a straight line.

Figure 2:
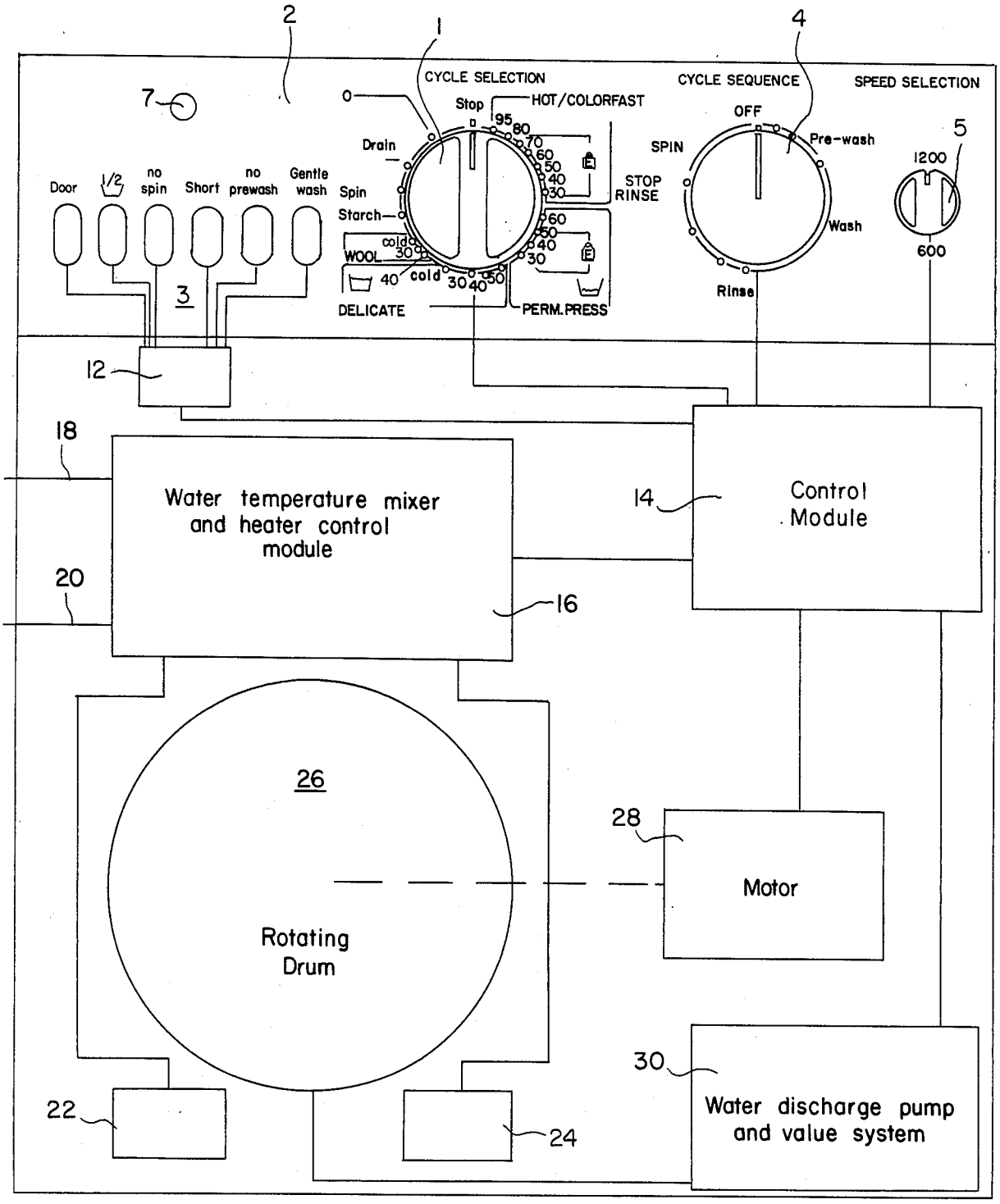
FIG. 2 shows a washing machine in which the embodiment of FIG. 1 may be used.

For each wash cycle, there is a variable temperature range which can be set separately. In FIGS. 1 and 2, temperature stages between 30° C. and 95° C. can be set for the "Hot/Colorfast" or "Regular" cycle. The "Permanent Press" cycle offers a temperature range between 30° C. and 60° C., the "Delicate" cycle between cold and 60° C., and the "Wool" cycle between cold and 40° C. In an alternate embodiment of the invention, it would also be possible to make the corresponding temperature ranges continuously adjustable.

The auxiliary functions customary in a wash cycle can be set by separate push buttons 3. A cycle sequence indicator 4 located next to the cycle selection switch 1 shows, in the manner of the prior art, the current status of the washing machine cycle. A desired spin speed can be selected by means of an additional speed selector switch 5.

The control panels of FIG. 1 will now be described in more detail. Starting at the left of the control panel, as shown in FIG. 1, the auxiliary functions 3 customarily found on a washing machine are provided, in the present embodiment which is the preferred embodiment, by a series of buttons. The left most button is Door which controls the opening of the door of the washing machine. The second button is a button which controls the level of the water in the washing machine. In this particular, preferred and representative embodiment, the water level can be adjusted between a full washing machine water level and a half water level. The next button is a button which deactivates the spin and is called a No Spin button. The forth button from the left is a Short cycle button which shortens the cycles or cycle in the washing sequence, as is well known in the prior art. The fifth button from the left is a No Pre-wash button where the pre-wash is either connected so that it is operational or it is skipped and the washing machine goes into a wash cycle immediately after being started. The sixth and last button from the left is a Gentle Wash button which adjusts the speed of the spin between a normal spin and a gentle wash.

The cycle selection switch 1 dial arrangement starts at the 12:00 o'clock position in a Stop mode. As the dial member of the cycle selection switch 1 first is rotated clockwise in this preferred embodiment to a "Hot/-Colorfast" or "Regular" cycle selection, this cycle selection, as indicated previously, can be adjusted from preferably a high of 95° C. to a low of 30° C. In the preferred embodiment, the temperatures are listed as 95° C., 80° C., 70° C., 60° C., 50° C., 40° C. and 30° C. In addition, there is an indication between 30° C. and 80° C. which encompasses an E range, which may be a preferred temperature range of water for a particular fabric which is to be washed in that particular cycle. From approximately the 3:00 o'clock position on the cycle selector switch to approximately the 5:00 o'clock position on the same switch, the Permanent Press cycle is disposed. The temperatures in the Permanent Press cycle, beginning at approximately the 3:30 o'clock position, start at 60° C. then 50° C., 40° C. and 30° C. The 30° C. setting is at approximately the 5:00 o'clock position. Also, an indicator E encompasses the 30° C. to 50° C. range, which may be a preferred temperature range of water for a particular fabric which is to be washed in that particular cycle. Also, there is an indicator which indicates that the Permanent Press cycle uses less water than other cycles may use.

A Delicate wash cycle is disposed from approximately the 5:30 o'clock position to approximately the 6:30 o'clock position on the cycle selection switch 1. The temperatures indicated in FIG. 1 for the Delicate wash cycle are 50° C., 40° C., 30° C. and cold water. Also, there is an indicator which indicates that the water level is usually relatively high in the Delicate cycle.

Next following the Delicate cycle in the preferred embodiment shown in FIG. 1, the Wool cycle is disposed from approximately the 7:00 o'clock to the 8:00 o'clock positions. The Wool cycle has a 40° C. temperature indication at approximately the 7:00 o'clock position, then a 30° C. position, and finally, at approximately the 8:00 o'clock position, a cold water position for admitting cold water, without heating, into the washing machine.

Following the Wool cycle, at approximately the 8:45 o'clock position on the cycle selection switch 1, there is a Starch position which adjusts the temperature and cycle so that starch can be preferably optimally used in the washing machine.

At approximately the 9:15 o'clock position, there is a Spin cycle which is adapted to spin the clothes at an optimal or desired speed. The spin cycle is also affected by the position of the gentle wash switch to the left.

Following the Spin cycle, at approximately the 10:00 o'clock position on the cycle selection switch 1, there is a Drain or Pumping cycle.

Following this cycle there is a 0 cycle which is indicated by a 0 or O at approximately the 11:00 o'clock position.

The cycle sequence control 4, shown in FIG. 1 to the right of the cycle selector switch 1, operates in much the same manner as the cycle sequence selector does on many prior art washing machines. At the 12:00 o'clock position, there is an off position, and as the cycle sequence selector 4 is rotated clockwise, there is a Starting position at approximately the 12:30 or 1:00 o'clock position, a Pre-wash position, which indicates a pre-wash cycle, which is disposed between the 12:30 o'clock position and the 2:00 o'clock position. From the 2:00 o'clock position to approximately the 6:30 o'clock position there is a wash cycle. From the 6:30 o'clock position to approximately the 7:30 o'clock position, there is a first rinse cycle and then there are two subsequent rinse cycles until a position indicating a Stop Rinse position, at approximately the 9:30 o'clock position, is attained. After the rinse is stopped, a Spin cycle can commence, which is disposed between approximately the 9:30 o'clock position to the 12:00 o'clock position.

To the right of the cycle sequence control 4, there is disposed a speed selection switch 5. This speed selection switch 5, in this preferred embodiment, is shown with a high speed of 1200 and a low speed of 600. The speed selection can be for different speeds other than the speeds indicated and may be at any speed which is adapted for use with a particular design of a washing machine. The numbers 600 and 1200 may refer to the speed of a particular component in the drive train of the drum member in the washing machine, and preferably indicate 600 revolutions per minute and 1200 revolutions per minute of this component, which may be the gear or belt drive motor.

In addition, there is a lamp 7 disposed above the auxiliary function buttons 3, which indicates whether the washing machine is on or off.

Referring now to FIG. 2, at the top thereof, the control panel 2 of FIG. 1 is shown once again. The auxiliary functions 3, which are controlled by the buttons, are all connected via a connecting cable system 12 to a control module 14. The cycle selection switch 1, the cycle sequence control 4 and the speed selector switch 5 are also connected to this control module 14. The control module 14 may alternatively be a series of modules which are independent of one another but perform the same functions as the control module 14 of a conventional washing machine, which modules are well known in the art. To the control module 14, a water temperature mixer and heater control module 16 is connected and controlled thereby. Hot water inlet apparatus 18 and cold water inlet apparatus 20 are connected with and controlled by the water temperature mixer and heater control module 16. As stated previously, the hot water mixer and heater control module 16 may also, as in the control module 14, be a series of modules which are separate from one another as an alternative to the single module shown in FIG. 2. A water temperature sensor 22 is preferably disposed for immersion in at least a portion of the water which is being used for washing in the washing area of the washing machine. This water temperatures sensor 22, if present, is connected to the water temperature mixer and heater control module 16 and functions in a customary manner in order to adjust the temperature of the water with the aid of the water temperature mixer and heater control module 16. Preferably, also connected to the water temperature mixer and heater control module 16 is a water heater 24, which, if present, heats the water in the washing machine to a desired temperature which has been preselected by the cycle selection dial 1. Alternatively, the temperatures of the water may be achieved by mixing hot and cold water. A rotating drum 26 and a motor 28 connected thereto are shown mechanically connected by the dashed line therebetween. The drum 26 is shown preferably as a horizontal drum for a front load washing machine. The clothes are disposed in the rorating drum 26, and the drum 26 is driven by the motor 28 in a conventional fashion, well known in the prior art. The motor 28 is also connected to the control module 14 which adjusts the speed, timing and possibly even the direction thereof. Preferably, a water discharge pump and valving system 30 is connected to remove the water from the washing machine washing area and discharge it from the machine at appropriate times controlled by the control module 14 to which it is connected.

The cycle sequence control 4 is typically driven by a motor, as is well known in the prior art, to indicate the exact cycle of the machine at a particular time and is reset to the off cycle and stopped when the cycle is completed. The cycle selection dial 1 may also have such a reset feature which resets the cycle selection dial to the stop position at the end of a cycle or, alternatively, the cycle selection dial 1 may remain as selected throughout the cycle and thereafter.

The advantages of the invention, as illustrated in the figures, are apparent and include ease of operation and simplicity of the cycle selection elements.

Figure 3:
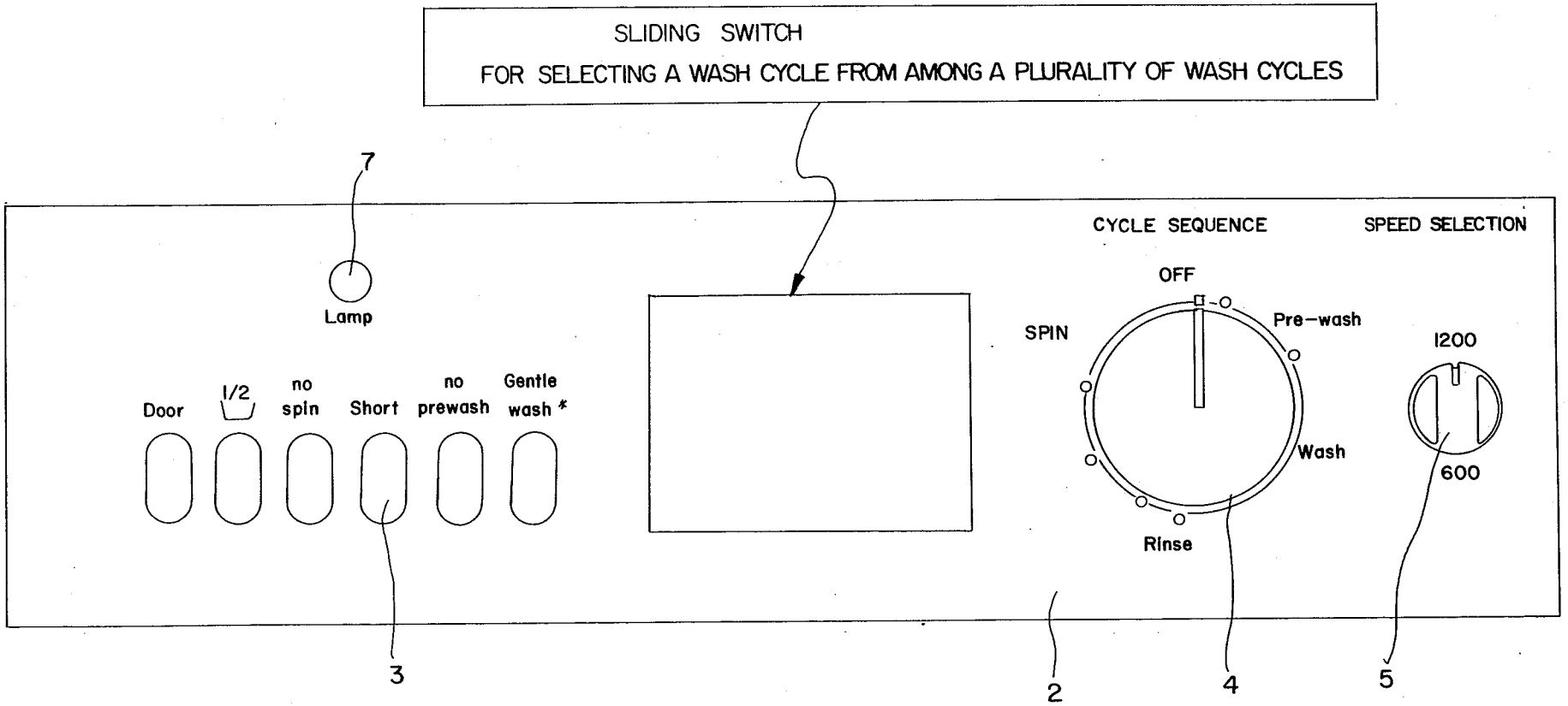
FIG. 3 shows a washing machine in which an alternate embodiment of the invention is shown.

FIG. 3 shows an alternative embodiment of the invention in which a sliding switch is used for selecting a wash cycle among a plurality of wash cycles. The sliding switch of FIG. 3 is an alternative embodiment to the rotary switch as shown in FIG. 1.

The invention as described hereinabove in the context of the preferred embodiments is not to be taken as limited to all of the provided details thereof, since modifications and variations thereof may be made without departing from the spirit and scope of the invention.

What is claimed is:

1. An automatic washing machine with a plurality of wash cycles having:

motor means and a wash drum mechanically connected to said motor means;

water inlet means for admitting water into said washing machine;

water temperature control means connected to control the temperature at least of the water in said washing machine;

a control panel being disposed on said automatic washing machine;

means for selecting a wash cycle among a plurality of wash cycles of said automatic washing machine being disposed on said control panel, said selecting means comprising a single, unitary, rotary switch for selecting a wash cycle among a plurality of wash cycles, said rotary switch having means for disposing each wash cycle on its own arcuate portion of said rotary switch;

said single rotary switch having means for moving between and indicating said plurality of wash cycles along a single circular coordinate, indicating said plurality of wash cycles;

each said wash cycle having a predetermined wash temperature range associated therewith;

said rotary switch having means for restricting a water temperature range within its predetermined, specific, individual temperature range for its corresponding wash cycle, said means for restricting a water temperature range within its predetermined, specific, individual temperature range for its corresponding wash cycle having means for disposing water temperatures for each wash cycle in the corresponding arcuate portion representing that wash cycle;

means for displaying each said wash cycle and its temperature range, each said temperature range being restricted to its predetermined temperature range for its wash cycle;

cycle data being disposed on said displaying means and arranged in a circular fashion with respect to said rotary switch;

said rotary switch being connected to said water temperature control means to control temperature of at least the water in said washing machine; whereby a predetermined variably adjustable temperature range is assigned to each of the individual wash cycles, each of these temperature ranges lies within the limits allowable for the appropriate fabrics to be washed in that wash cycle and whereby a selection of wash cycle and temperature can only be made which correspond to a desired wash cycle and a temperature in its predetermined temperature range in one unambiguous and unitary selection, and whereby a wash cycle and a water temperature are selectable in a single, continuous movement of said rotary switch.

2. The washing machine according to claim 1, wherein said displaying means are disposed on said control panel circularly disposed about said rotating switch.

3. The washing machine according to claim 1, wherein said displaying means comprises arcuate regions about said rotary switch, each indicating a wash cycle and that cycle's predetermined temperature range within each wash cycle.

4. The washing machine according to claim 1, including auxiliary cycle control means comprising a plurality of individual push button means for controlling a plurality of auxiliary cycles.

5. The washing machine according to claim 4, wherein said push button means include on button means for controlling a short wash cycle.

6. The washing machine according to claim 5, including cycle sequence indicator means separate from said unitary wash cycle control.

7. The washing machine according to claim 6, wherein said means for selecting various wash cycles has a first cycle for regular wash and said temperature selection means thereof has means for selecting a temperature in a temperature range from about 30° C. to about 95° C., and said means for selecting various wash cycles has a second cycle for permanent press wash and said temperature selection means thereof has means for selecting a temperature in a temperature range from about 30° C. to about 60° C., and said means for selecting various wash cycles has a third cycle for delicate wash and said temperature selection means thereof has means for selecting a temperature in a temperature range from about cold water temperature to about 60° C., and said means for selecting various wash cycles has a forth cycle for wool wash and said temperature selection means thereof has means for selecting a temperature in a temperature range from about cold water temperature to about 40° C.

8. The washing machine according to claim 1, including cycle sequence indicator means separate from said unitary wash cycle control.

9. The washing machine according to claim 1, wherein said rotary switch for selecting various wash cycles has a first cycle for regular wash and said temperature selection means thereof has means for selecting a temperature in a temperature range from about 30° C. to about 95° C., and said means for selecting various wash cycles has a second cycle for permanent press wash and said temperature selection means thereof has means for selecting a temperature in a temperature range from about 30° C. to about 60° C., and said means for selecting various wash cycles has a third cycle for delicate wash and said temperature selection means thereof has means for selecting a temperature in a temperature range from about cold water temperature to about 60° C., and said means for selecting various wash cycles has a forth cycle for wool wash and said temperature selection means thereof has means for selecting a temperature in a temperature range from about cold water temperature to about 40° C.

10. An automatic washing machine having motor means and a wash drum mechanically connected to said motor means, said washing machine comprising:

water inlet means for admitting water into said washing machine;

water temperature control means connected to control a temperature at least of water in said washing machine;

a control panel being disposed on said automatic washing machine;

a unitary wash cycle selector control for selecting a wash cycle among a plurality of wash cycles of said automatic washing machine, said cycle selector being disposed on said control panel and comprising a single, unitary switch for selecting a wash cycle among a plurality of wash cycles, said single, unitary switch comprising a rotary switch, said rotary switch having means for disposing each wash cycle on its own contiguous portion of movement of said cycle selector;

said unitary wash cycle selector control being connected to and controlling said water temperature control means, said unitary wash cycle selector control comprising:

means for selecting various wash cycles with said unitary wash cycle selector control;

said wash cycles being disposed in a substantially continuous fashion, one after the other, along a selection sequence of said unitary wash cycle selector control;

each of said washing machine cycles for various washing machine conditions having its own corresponding temperature selection means, each temperature selection means having a temperature selection range, each said temperature selection range lying within its own individual predetermined range, each individual predetermined range having temperature indicators being disposed within its contiguous portion on the unitary wash cycle selector control;

each of said predetermined ranges of temperature being equivalent to appropriate ranges of temperature for fabrics to be washed in each corresponding cycle;

said unitary wash cycle selector control having means for restricting choice of said wash temperatures to limit choice of water temperature in each individual wash cycle within a predetermined range for that corresponding wash cycle; and means for displaying said selected wash cycle and a temperature range restricted to a corresponding temperature range of the selected wash cycle, whereby saud unitary wash cycle selector control comprises a single structure for selecting a wash cycle and a predetermined temperature within its wash cycle in one unambiguous and unitary selection, and whereby a wash cycle and a water temperature are selectable in a single, substantially continuous and substantially uninterrupted movement of said unitary wash cycle selector control.

11. The washing machine according to claim 10, wherein said unitary wash cycle selector control comprises a round control.

12. The washing machine according to claim 11, wherein said round control comprises a rotary switch being connected to activate said means for selecting wash cycles and said means for selecting said temperature ranges within each cycle; and said displaying means comprising arctuate regions with respect to said control panel about said rotary switch, each indicating a wash cycle and that cycle's predetermined temperature range within each wash cycle.

13. The washing machine according to claim 12, including auxiliary cycle control means comprising a plurality of individual push button means for controlling a plurality of auxiliary cycles.

14. The washing machine according to claim 13, wherein said push button means include on button means for controlling a short wash cycle.

15. The washing machine according to claim 14, including cycle sequence indicator means separate from said unitary wash cycle selector.

16. The washing machine according to claim 15, wherein said means for selecting various wash cycles has a first cycle for regular wash and said temperature selection means thereof has means for selecting a temperature in a temperature range from about 30° C. to about 95° C., and said means for selecting various wash cycles has a second cycle for permanent press wash and said temperature selection means thereof has means for selecting a temperature in a temperature range from about 30° C. to about 60° C., and said means for selecting various wash cycles has a third cycle for delicate wash and said temperature selection means thereof has means for selecting a temperature in a temperature range from about cold water temperature to about 60° C., and said means for selecting various wash cycles has a forth cycle for wool wash and said temperature selection means thereof has means for selecting a temperature in a temperature range from about cold water temperature to about 40° C.

17. The washing machine according to claim 13, including cycle sequence indicator means separate from said unitary wash cycle selector control.

18. The washing machine according to claim 10, including cycle sequence indicator means separate from said unitary wash cycle selector control.

19. The washing machine according to claim 10, wherein said means for selecting various wash cycles has a first cycle for regular wash and said temperature selection means thereof has means for selecting a temperature in a temperature range from about 30° C. to about 95° C., and said means for selecting various wash cycles has a second cycle for permanent press wash and said temperature selection means thereof has means for selecting a temperature in a temperature range from about 30° C. to about 60° C., and said means for selecting various wash cycles has a third cycle for delicate wash and said temperature selection means thereof has means for selecting a temperature in a temperature range from about cold water temperature to about 60° C., and said means for selecting various wash cycles has a forth cycle for wool wash and said temperature selection means thereof has means for selecting a temperature in a temperature range from about cold water temperature to about 40° C.

20. An automatic washing machine with a plurality of wash cycles having:

motor means and a wash drum mechanically connected to said motor means;

water inlet means for admitting water into said washing machine;

water temperature control means connected to control the temperature at least of the water in said washing machine;

a control panel being disposed on said automatic washing machine;

means for selecting a wash cycle among a plurality of wash cycles of said automatic washing machine being disposed on said control panel, said selecting means comprising a single, unitary, rotary switch for selecting a wash cycle among a plurality of wash cycles;

said single rotary switch having means for moving between and indicating said plurality of wash cycles along a single circular coordinate indicating said plurality of wash cycles;

each said wash cycle having a predetermined water temperature range associated therewith;

said rotary switch having means for restricting a water temperature range within its predetermined, specific, individual temperature range for its corresponding wash cycle;

means for displaying each said wash cycle and its temperature range, each said temperature range being restricted to its predetermined temperature range for its wash cycle;

cycle data being disposed on said displaying means and arranged in a circular fashion with respect to said rotary switch;

said rotary switch being connected to said water temperature control means to control temperature of at least the water in said washing machine; whereby a predetermined variably adjustable temperature range is assigned to each of the individual wash cycles, each of these temperature ranges lie within the limits allowable for the appropriate fabrics to be washed in that wash cycle, whereby a selection of wash cycle and temperature can only be made which correspond to a desired wash cycle and a temperature in its predetermined temperature range in ona unambiguous and unitary selection, and whereby a wash cycle and a water temperature are selectable in a single movement of said rotary switch.

21. An automatic washing machine having motor means and a wash drum mechanically connected to said motor means, said washing machine comprising:

water inlet means for admitting water into said washing machine;

water temperature control means connected to control a temperature at least of water in said washing machine;

a control panel being disposed on said automatic washing machine;

a unitary wash cycle selector control for selecting a wash cycle among a plurality of wash cycles of said automatic washing machine, said cycle selector being disposed on said control panel and comprising a single, unitary switch for selecting a wash cycle among a plurality of wash cycles, said single, unitary switch comprising a sliding switch, said sliding switch having means for disposing each wash cycle on its own contiguous portion of movement of said cycle selector;

said unitary wash cycle selector control being connected to and controlling said water temperature control means, said unitary wash cycle selector control comprising:

means for selecting various wash cycles with said unitary wash cycle selector control;

said wash cycles being disposed in a substantially continuous fashion, one after the other, along a selection sequence of said unitary wash cycle selector control;

each of said washing machine cycles for various washing machine conditions having its own corresponding temperature selection means, each temperature selection means having a temperature selection range, each said temperature selection range lying within its own individual predetermined range, each individual predetermined range having temperature indicators being disposed within its contiguous portion on the unitary wash cycle selector control;

each of said predetermined ranges of temperature being equivalent to appropriate ranges of temperature for fabrics to be washed in each corresponding cycle;

said unitary wash cycle selector control having means for restricting choice of said water temperatures to limit choice of water temperature in each individual wash cycle within a predetermined range for that corresponding wash cycle; and means for displaying said selected wash cycle and a temperature range restricted to a corresponding temperature range of the selected wash cycle, whereby said unitary wash cycle selector control comprises a single structure for selecting a wash cycle and a predetermined temperature within its wash cycle in one unambiguous and unitary selection, and whereby a wash cycle and a water temperature are selectable in a single, substantially continuous and substantially uninterrupted movement of said unitary wash cycle selector control.

* * * * *